US007992764B2

(12) United States Patent
Magnusson

(10) Patent No.: US 7,992,764 B2
(45) Date of Patent: Aug. 9, 2011

(54) FOLDING CARTON AND CORRESPONDING MANUFACTURING MACHINE

(75) Inventor: Birgir Magnusson, Paippinen (FI)

(73) Assignee: Nokia Corporation, Espoo (FI)

( * ) Notice: Subject to any disclaimer, the term of this patent is extended or adjusted under 35 U.S.C. 154(b) by 117 days.

(21) Appl. No.: 12/086,508

(22) PCT Filed: Dec. 7, 2006

(86) PCT No.: PCT/IB2006/054653

§ 371 (c)(1),
(2), (4) Date: Aug. 21, 2009

(87) PCT Pub. No.: WO2007/072267

PCT Pub. Date: Jun. 28, 2007

(65) Prior Publication Data

US 2010/0012710 A1 Jan. 21, 2010

(30) Foreign Application Priority Data

Dec. 19, 2005 (CN) ..... 2005 2 0146178 U

(51) Int. Cl.
*B65D 5/487* (2006.01)
*B65D 25/04* (2006.01)

(52) U.S. Cl. ..... 229/120.12; 229/117; 229/120.13; 229/120.18

(58) Field of Classification Search ..... 229/117, 229/120.08, 120.12, 120.13, 120.17, 120.18, 229/120.21; 206/316.2, 725, 784
See application file for complete search history.

(56) References Cited

U.S. PATENT DOCUMENTS

| | | | | |
|---|---|---|---|---|
| 2,069,997 | A * | 2/1937 | Carr | 206/169 |
| 2,529,595 | A | 11/1950 | Cody | |
| 2,670,125 | A * | 2/1954 | Frankenstein | 206/784 |
| 3,780,931 | A | 12/1973 | Hanson | |
| 4,349,105 | A * | 9/1982 | Bradley et al. | 206/317 |
| 4,438,848 | A * | 3/1984 | Montealegre et al. | 206/588 |
| 5,495,983 | A * | 3/1996 | Lelek | 229/120.13 |
| 7,004,314 | B2 * | 2/2006 | Pucillo et al. | 206/217 |
| 7,036,716 | B2 * | 5/2006 | Kanamori et al. | 229/120.21 |
| 2001/0027993 | A1 * | 10/2001 | Smith et al. | 229/168 |
| 2002/0125306 | A1 | 9/2002 | Jamitzky et al. | |
| 2005/0061861 | A1 * | 3/2005 | Pennino | 229/120.13 |

FOREIGN PATENT DOCUMENTS

| | | |
|---|---|---|
| EP | 0769366 | 4/1997 |
| EP | 0978449 | 2/2000 |
| EP | 1241104 | 9/2002 |

(Continued)

*Primary Examiner* — Gary E Elkins
(74) *Attorney, Agent, or Firm* — Alfred A. Fressola; Ware, Fressola, Van Der Sluys & Adolphson LLP

(57) ABSTRACT

The invention relates to a folding carton for the preservation and for the transport of goods with a reduced complexity, comprising a front wall element, a rear wall element, side wall elements connected to the front wall element and to the rear wall element by fold lines, a lid connected to the front wall element by a fold line, a base connected to at least one of the front wall element, the rear wall element and the side wall elements by a fold line and a separation flap element connected to one of the rear wall element and the side wall elements by a fold line, wherein the separation flap element comprises a plurality of flap sections, the flap sections by folding being arranged relative to each other in such a way that at least three compartments are formed.

10 Claims, 2 Drawing Sheets

FOREIGN PATENT DOCUMENTS

| | | | | | |
|---|---|---|---|---|---|
| EP | 1516817 | | | 3/2005 | |
| FR | 1346216 | | | 12/1963 | |
| FR | 2785846 | | | 5/2000 | |
| JP | 6-24436 | A | * | 2/1994 | ..... 229/120.13 |
| JP | 2000-142672 | A | * | 5/2000 | |
| WO | WO 99/28118 | | | 6/1999 | |

* cited by examiner

FOLDING CARTON AND CORRESPONDING MANUFACTURING MACHINE

CROSS REFERENCE TO RELATED APPLICATIONS

This application is the U.S. National Stage of International Application Number PCT/IB2006/054653 filed on Dec. 7, 2006 which was published in English on Jun. 28, 2007 under International Publication Number WO 2007/072267.

TECHNICAL FIELD

The invention relates to a folding carton for the preservation and for the transport of goods, in particular a mobile phone with respective accessories. Furthermore, the invention relates to a corresponding manufacturing machine for the fabrication of a folding carton.

BACKGROUND OF THE INVENTION

Folding cartons of the type described above are for example used in the field of sales packages for mobile phones. Sales packages are generally put in master cartons and these master cartons are placed on pallets. In order to fit more pieces per pallet, it is important to make as small packages as possible.

The problem is that a sales package needs some sort of separator to separate the contents of the package, especially the mobile phone from its respective accessories, e.g. from the user guide, the charger and the battery. There are two types of separators known in the state of the art.

According to the first type the separators and corresponding compartments for the mobile phone, the user guide, the charger, the battery and the like are formed by trays. Such trays have several cavities, usually three or four, depending on the contents of the package. These cavities are separated by walls, which walls need space. Therefore, the problem when using trays is that relative large boxes are required. Another problem is that to form the final sales package, several parts of different materials, the box on one hand and the tray on the other hand, have to be fabricated which leads to relatively high production costs.

According to the second type of separators, the separators are part of folding cartons. Such folding cartons have the advantage of being relatively compact compared to boxes with trays. But the problem of existing folding cartons with folding carton separators for a mobile phone and the respective accessories, e.g. charger, battery, user guide and the like, is that they are relatively complex. When using such folding cartons, not only their fabrication is complex which leads to relatively high production costs, but also the opening action is difficult and time-consuming because of the complexity of the folding.

SUMMARY OF THE INVENTION

It is an object of the invention to provide a folding carton for the preservation and for the transport of goods with a reduced complexity.

According to a first aspect of the present invention a folding carton for the preservation and for the transport of goods, in particular a mobile phone with respective accessories, is provided, comprising a front wall element, a rear wall element, side wall elements, connected to the front wall element and to the rear wall element by fold lines, a lid connected to the front wall element by a fold line, a base connected to at least one of the front wall element, the rear wall element and the side wall elements by a fold line and a separation flap element connected to one of the rear wall element and the side wall elements by a fold line, wherein the separation flap element comprises a plurality of flap sections, the flap sections by folding being arranged relative to each other in such a way that at least three compartments are formed.

By using a separation flap element which is connected to one of the wall elements and which comprises a plurality of flap sections forming at least three compartments, the complexity of the folding carton is reduced compared with known folding cartons. Furthermore, the packing time is reduced, since the number of parts of the carton is reduced to a minimum, in particular to a single one in the case that the folding carton is made of a one-piece blank. Furthermore, the number of folding actions needed to pack the product is reduced to a minimum, in particular to three, which will be explained in detail later on. Another advantage is that the material usage as well as the cost of material is reduced.

The folding carton according to the present invention allows for example to place a mobile phone, a charger and a battery in respective separate compartments. It is also possible to place a user guide inside one of the compartments, for example together with the charger. Also a quick guide can be provided, which preferably is visible when opening the lid.

According to another embodiment of the folding carton of the present invention each compartment is separated from the other compartments by at least one of the flap sections. This allows to place different contents in different compartments such that the contents, for example the mobile phone, the charger and the battery, do not come into contact with each other when transporting the folding carton.

According to another embodiment of the folding carton of the present invention adjacent flap sections are arranged perpendicular to each other. This allows to easily form separate compartments in different areas of the folding carton, in different heights inside the carton, in different dimensions and/or in different orientations. Additionally or alternatively it is thinkable that at least two flap sections are arranged in planes extending parallel to each other.

According to a further embodiment of the folding carton of the present invention at least one flap section has two adjacent flap sections, which flap sections are folded around folding axes extending perpendicular to each other. Using such perpendicularly extending folding axes allows to form separate compartments which are oriented in different perpendicular directions, thereby providing a compact storage solution.

Additionally it is advantageous when the at least one flap section has a smaller width than the adjacent flap section. For example, the mobile phone could be stored in a compartment extending from one side wall element to the opposite side wall element, whereas the battery could be stored in a further compartment extending from the front wall element to the separation wall of the mobile phone compartment, wherein the remaining space could be used for storage of the charger and the user guide.

According to another embodiment of the folding carton of the present invention the at least one flap section is connected to the rear wall element or to one of the side wall elements. Preferably, the at least one flap section has a smaller width than the wall element to which it is connected.

According to a further embodiment of the folding carton of the present invention the base comprises a plurality of flap elements interacting with each other to form a crush-lock bottom. Such a crush-lock bottom has the advantage that the box erects in one single movement. Preferably, in this case only one folding action is required for folding the wall elements and the base.

According to yet another embodiment of the folding carton of the present invention the folding carton is at least partly made of paperboard. This is a relatively low cost material with excellent mechanical properties.

According to a second aspect of the present invention a manufacturing machine for the fabrication of a folding carton as described above is provided, comprising means for carrying out a first folding action for folding the wall elements and the base, means for carrying out a second folding action for folding the separation flap element and means for carrying out a third folding action for closing the lid.

The manufacturing machine according to the present invention allows the fabrication of a folding carton as described above by just three separate folding actions, which reduces the packing time and thereby the production costs.

In a first folding action the wall elements and the base are folded, preferably by using a crush-lock bottom with which the box may be erected in one movement. After the first folding action the user guide and charger may be placed in the box.

Afterwards, by carrying out the second folding action the separation flap element with the plurality of flap sections is folded resulting in preferably two designated areas for the phone and the battery. Then the phone and battery may be put in place.

Finally, by carrying out the third folding action the lid is closed. The folding carton is now ready for transportation.

According to another embodiment of the manufacturing machine of the present invention means for cutting out a corresponding one-piece blank are provided. Such a manufacturing machine is able to fabricate a folding carton as described above preferably from one single sheet of paperboard. It is also possible, to fabricate a plurality of such folding cartons from one single sheet of paperboard.

As already described above, preferably after the first folding action and/or the second folding action already some of the contents of the package may be put in place. According to a further embodiment of the manufacturing machine of the present invention means for placing goods into the folding carton are provided for this purpose, in particular means for placing a mobile phone and respective accessories inside.

BRIEF DESCRIPTION OF THE DRAWINGS

The features of the present invention presented above as well as other features will now be described in greater detail with reference to the attached drawings.

DETAILED DESCRIPTION

Figure 2:
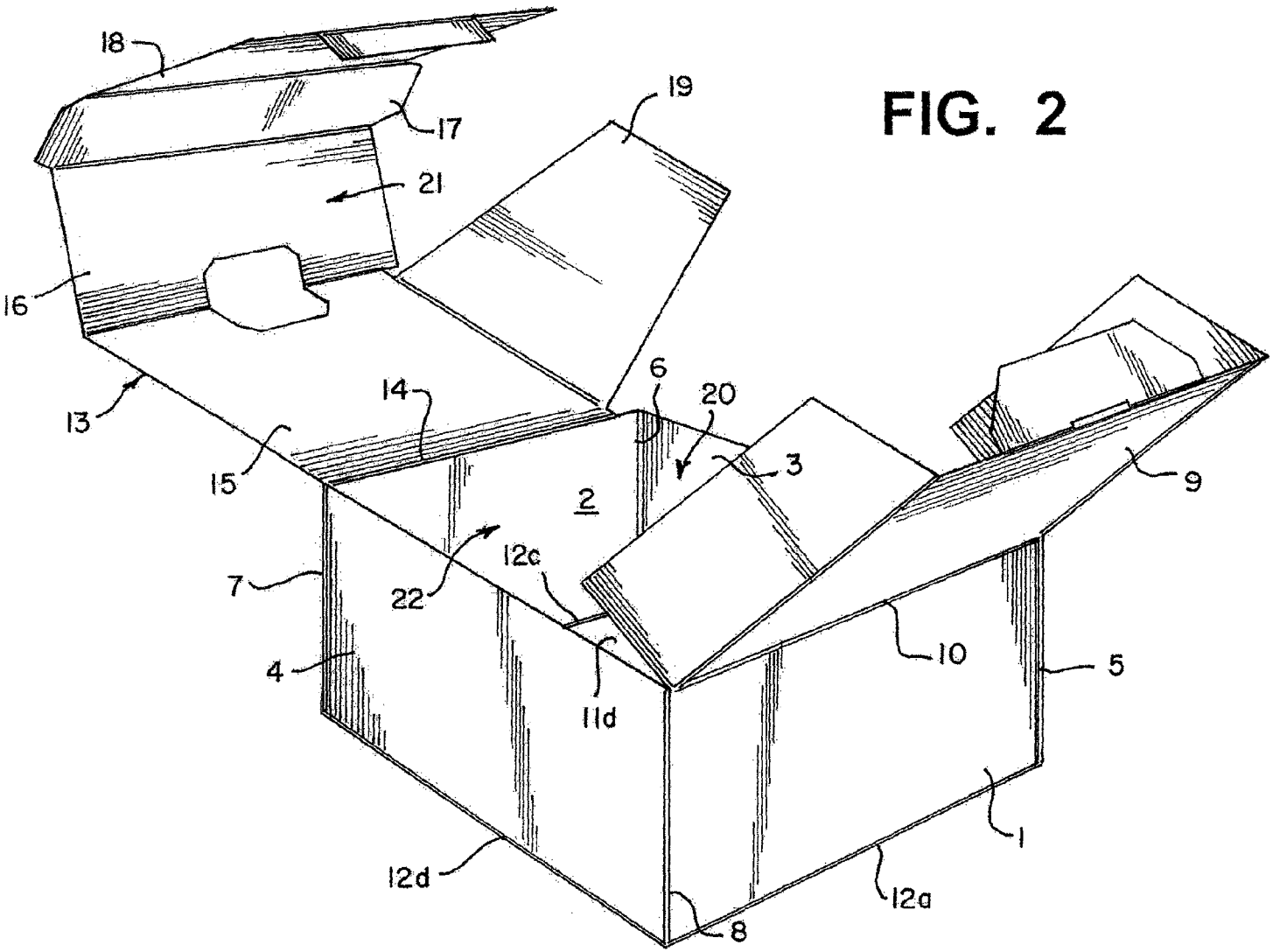
FIG. 2 is a perspective view of a folding carton formed from folding the one-piece blank shown in FIG. 1.

As best seen in FIG. 2, when folding the one-piece blank, which in the present case is made of paperboard, a folding carton is formed, comprising a front wall element 1, a rear wall element 2, two side wall elements 3 and 4 connected to the front wall element 1 and to the rear wall element 2 by fold lines 5, 6, 7 and 8. Furthermore, the folding carton comprises a lid 9 connected to the front wall element 1 by a fold line 10 and a base 11*a*, 11*b*, 11*c* and 11*d* in form of a crush-lock bottom, the base being connected to all wall elements 1, 2, 3 and 4.

To form separate compartments 20, 21 and 22 for the storage of the mobile phone, the charger and the battery, the folding carton further comprises a separation flap element 13 connected to the rear wall element 2 by a fold line 14, wherein the separation flap element 13 comprises a plurality of flap sections 15, 16, 17, 18 and 19. These sections could be arranged by folding relative to each other in such a way that three compartments 20, 21 and 22 are formed.

Figure 1:
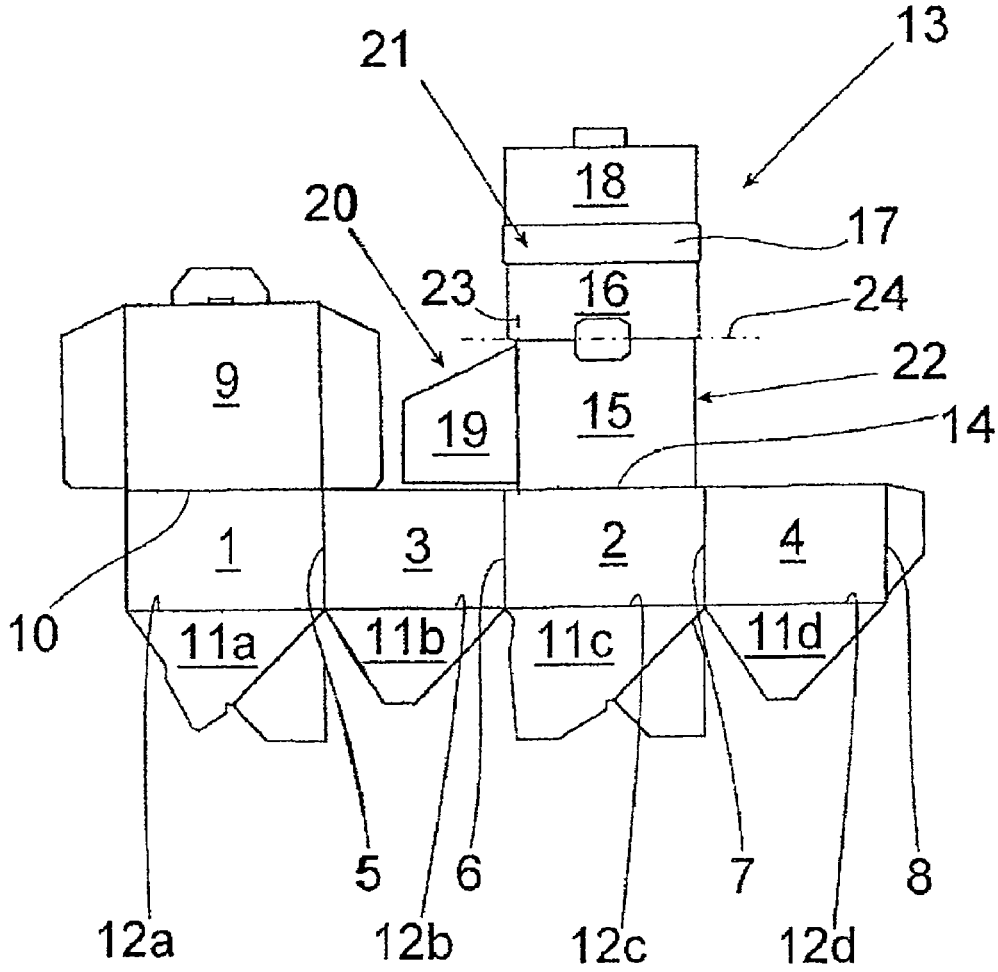
FIG. 1 shows a one-piece blank for a folding carton according to the present invention. Such a folding carton could be used for the preservation and for the transport of a mobile phone with respective accessories, e.g. a charger, a user guide and a battery.

As can be seen already from the one-piece blank illustrated in FIG. 1, each compartment 20, 21 and 22 of the folding carton is separated from the other compartments by one of the flap sections 15 to 19. For example, the compartment 20 for the battery is separated from the compartment 22 for the user guide and charger by the flap section 19. Furthermore, the compartment 20 for the battery is separated from the compartment 21 for the mobile phone by a part of the flap section 16. Finally, the compartment 22 for the user guide and charger is separated from the compartment 21 for the mobile phone by the flap sections 16 and 17.

The compartment 20 for the battery is formed by a space between the side wall element 3 and the flap section 19, the space being formed by using a flap section 15 having a smaller width than the wall element 2 to which it is connected.

As already described above, the advantages of the present invention are an increased speed of packing, a reduction of number of parts, since the sales package and folding carton tray are combined, a reduction of the overall material cost of the package and a reduction of the sides of the package to a minimum resulting in lower costs of logistics.

The invention claimed is:

1. A folding carton comprising:

a front wall element, a rear wall element, a first side wall element connected to the front wall element and to the rear wall element by fold lines and a second side wall element connected to at least one of the front wall element and the rear wall element by a fold line a lid connected to the front wall element by a fold line, a base, comprising a plurality of base flap elements, each base flap element being connected to at least one of the front wall element, the rear wall element and the first and second side wall elements by a fold line, wherein the plurality of base flap elements interact with each other to form a crush-lock bottom, and a separation flap element connected to one of the rear wall element and the first and second side wall elements by a separation flap fold line, wherein the separation flap element comprises a plurality of flap sections, the flap sections by folding being arranged relative to each other in such a way that at least three compartments are formed, wherein at least one flap section of the separation flap element is connected to two adjacent flap sections of the separation flap element by fold lines, the fold lines having folding axes extending perpendicular to each other, wherein the at least one flap section of the separation flap element has a width, parallel to the separation flap fold line, that is smaller than the width, parallel to the separation flap fold line, of one of the adjacent flap sections of the separation flap element, folded around a folding axis parallel to the separation flap fold line wherein the at least one flap section of the separation flap element is connected to the rear wall element or to one of the first and second side wall elements, wherein the at least one flap section of the separation flap element has a width, parallel to the separation flap fold line, that is smaller than the width, parallel to the separation flap fold line, of the rear wall element or first or second side wall element to which it is connected.

2. The folding carton according to claim 1, wherein each compartment is separated from the other compartments by at least one of the flap sections of the separation flap element.

3. The folding carton according to claim 1, wherein adjacent flap sections of the separation flap element are arranged perpendicular to each other.

4. The folding carton according to claim 1, wherein at least two flap sections of the separation flap element are arranged in planes extending parallel to each other.

5. The folding carton according to claim 1, wherein the folding carton is made of a one-piece blank.

6. The folding carton according to claim 1, wherein the folding carton is at least partly made of paperboard.

7. The folding carton according to claim 1 wherein the folding carton comprises a mobile phone and respective accessories and the folding carton is configured to preserve and transport the mobile phone and respective accessories.

8. A folding carton according to claim 1, wherein the at least one flap section of the separation flap element has first and second edges perpendicular to the separation flap fold line, and wherein the rear wall element or first or second side wall element to which the at least one flap section of the separation flap element is connected has third and fourth edges perpendicular to the separation flap fold line, wherein a distance between the first edge and the third edge where they meet the separation flap fold line is greater than the distance between the second edge and the fourth edge where they meet the separation flap fold line.

9. A one piece blank, configured to be folded to provide a folding carton, comprising:

a front wall element, a rear wall element, a first side wall element connected to the front wall element and to the rear wall element by fold lines and a second side wall element connected to at least one of the front wall element and the rear wall element by a fold line a lid connected to the front wall element by a fold line, a base, comprising a plurality of base flap elements, each base flap element being connected to at least one of the front wall element, the rear wall element and the first and second side wall elements by a fold line, wherein the plurality of base flap elements are configurable to form a crush-lock bottom, and a separation flap element connected to one of the rear wall element and the first and second side wall elements by a separation flap fold line, wherein the separation flap element comprises a plurality of flap sections, the flap sections being foldable relative to each other in such a way that at least three compartments may be formed, wherein at least one flap section of the separation flap element is connected to two adjacent flap sections of the separation flap element by fold lines, the fold lines having folding axes extending perpendicular to each other, wherein the at least one flap section of the separation flap element has a width, parallel to the separation flap fold line, that is smaller than the width, parallel to the separation flap fold line, of one of the adjacent flap sections of the separation flap element, foldable around a folding axis parallel to the separation flap fold line wherein the at least one flap section of the separation flap element is connected to the rear wall element or to one of the first and second side wall elements, wherein the at least one flap section of the separation flap element has a width, parallel to the separation flap fold line, that is smaller than the width, parallel to the separation flap fold line, of the rear wall element or first or second side wall element to which it is connected.

10. An apparatus comprising:

a front wall element, a rear wall element, a first side wall element connected to the front wall element and to the rear wall element by fold lines and a second side wall element connected to at least one of the front wall element and the rear wall element by a fold line a lid connected to the front wall element by a fold line, a base, comprising a plurality of base flap elements, each base flap element being connected to at least one of the front wall element, the rear wall element and the first and second side wall elements by a fold line, wherein the plurality of base flap elements interact with each other to form a crush-lock bottom, and a separation flap element connected to one of the rear wall element and the first and second side wall elements by a separation flap fold line, wherein the separation flap element comprises a plurality of flap sections, configured such that at least three compartments are formed, wherein at least one flap section of the separation flap element is connected by fold lines to two adjacent flap sections of the separation flap element, folded around folding axes extending perpendicular to each other, wherein the at least one flap section of the separation flap element has a width, parallel to the separation flap fold line, that is smaller than the width, parallel to the separation flap fold line, of one of the adjacent flap sections of the separation flap element, folded around a folding axis parallel to the separation flap fold line wherein the at least one flap section of the separation flap element is connected to the rear wall element or to one of the first and second side wall elements, wherein the at least one flap section of the separation flap element has a width, parallel to the separation flap fold line, that is smaller than the width, parallel to the separation flap fold line, of the rear wall element or first or second side wall element to which it is connected.

* * * * *